United States Patent [19]

Anderson

[11] 4,099,707

[45] Jul. 11, 1978

[54] VEHICLE MOVING APPARATUS

[75] Inventor: George Bernard Anderson, Ashland, Ky.

[73] Assignee: Allied Chemical Corporation, Morris Township, Morris County, N.J.

[21] Appl. No.: 765,313

[22] Filed: Feb. 3, 1977

[51] Int. Cl.[2] ..... B66F 11/00

[52] U.S. Cl. ..... 254/35; 104/162; 254/93 R; 198/736; 198/747

[58] Field of Search ..... 254/35, 93 R; 104/162, 104/176; 198/736, 747

[56] References Cited

U.S. PATENT DOCUMENTS 3,942,658 3/1976 Bonnaure ..... 104/162

*Primary Examiner*—Robert C. Watson

*Attorney, Agent, or Firm*—Patrick L. Henry; Michael S. Jarosz

[57] ABSTRACT

Apparatus for moving railroad cars, barges or the like along tracks includes three double-acting hydraulic cylinder mechanisms operatively supported from trackside overhead framework structure. A first, push-pull hydraulic mechanism is extensible and retractable within a plane parallel to the railroad tracks and the same is disposed toward one side of the tracks. A second, clamping hydraulic mechanism is supported upon the free end of the push-pull mechanism. As a result of the disposition of the first mechanism toward one side of the tracks, the clamping mechanism is able to positively clamp the upper side wall portion and said rail portion of the railroad car. Movement of the car in either a forward or backward mode is attained under the influence of the first mechanism. Alternatively, the push-pull mechanism can retard movement of the car and safely retains the car in a predetermined position when the mechanism is not actuated. The third, hoisting hydraulic mechanism elevates or lowers the first mechanism so as to, in turn, position the clamping mechanism relative to the railroad car side wall and side rail. The clamping mechanism may include guide devices for guiding the clamping members thereof into position relative to the railroad car side wall and side rail. An electrical-hydraulic control circuit combination is provided for operating the mechanisms. A lock-out and holding circuit for coordinating activation of the hoist mechanism with the clamping mechanism is provided.

7 Claims, 11 Drawing Figures

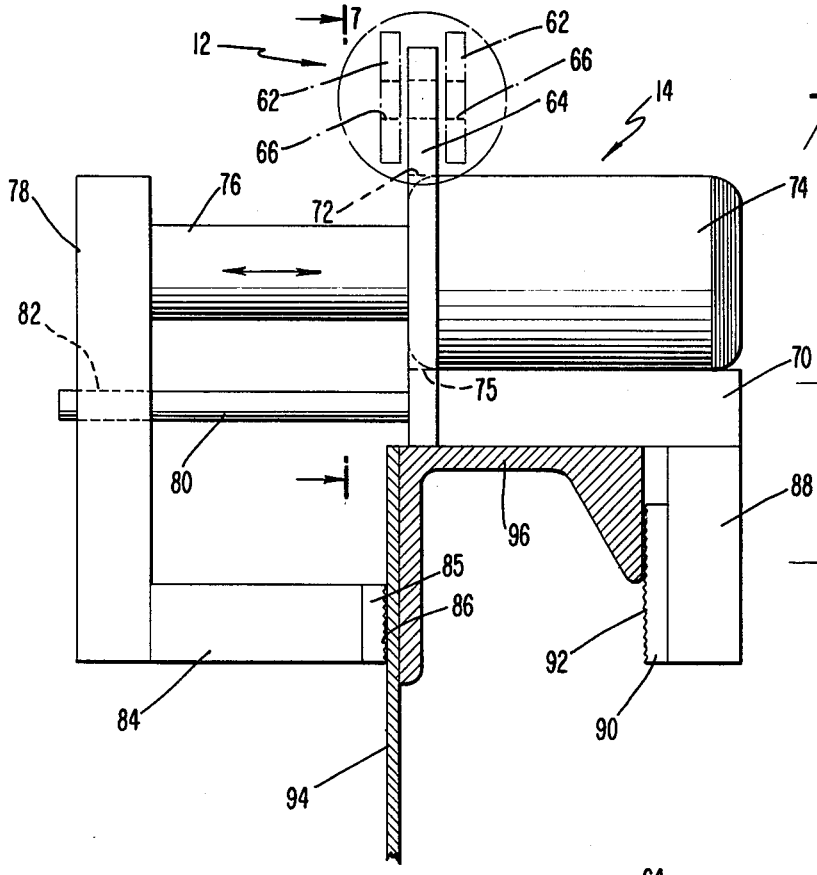
Fig. 6
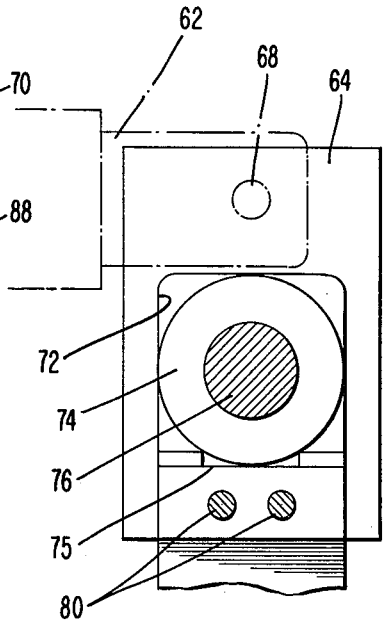
Fig. 7
Fig. 8
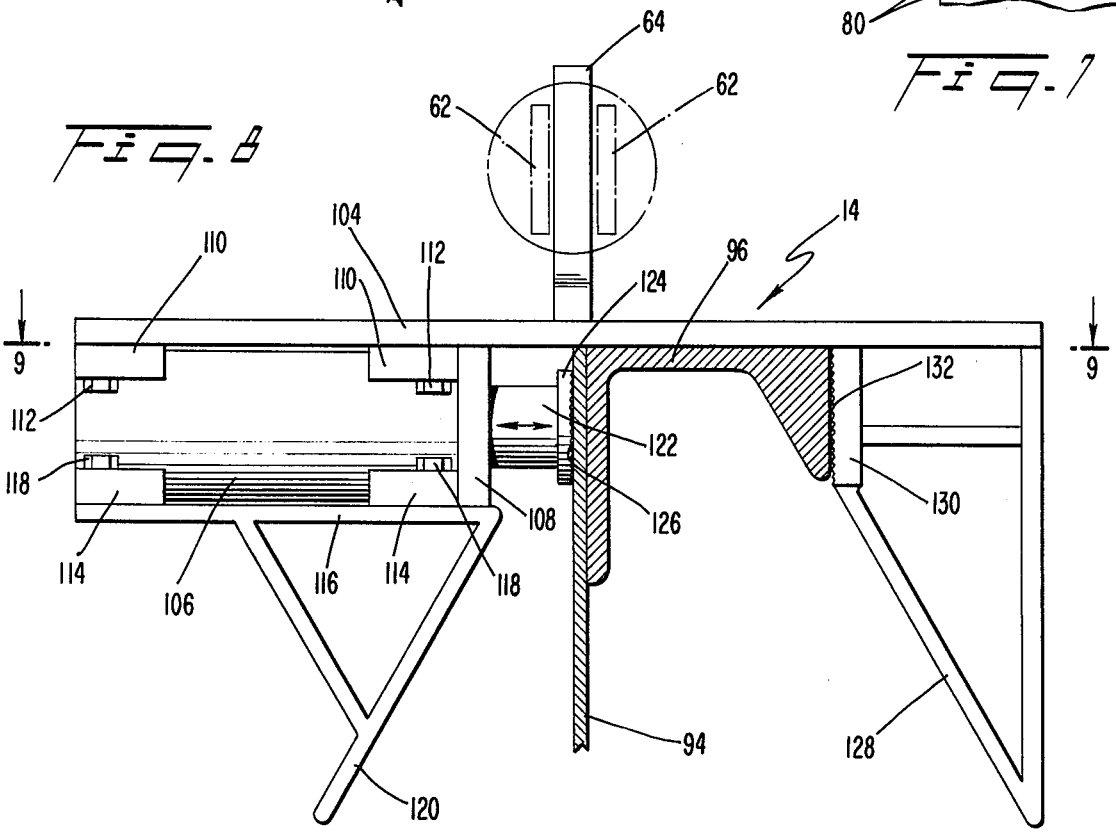

Fig. 9
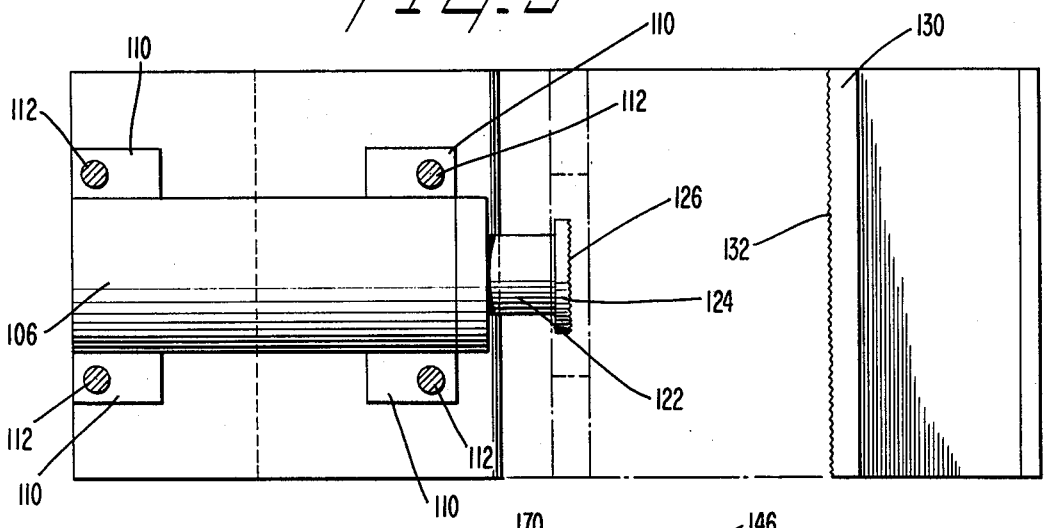
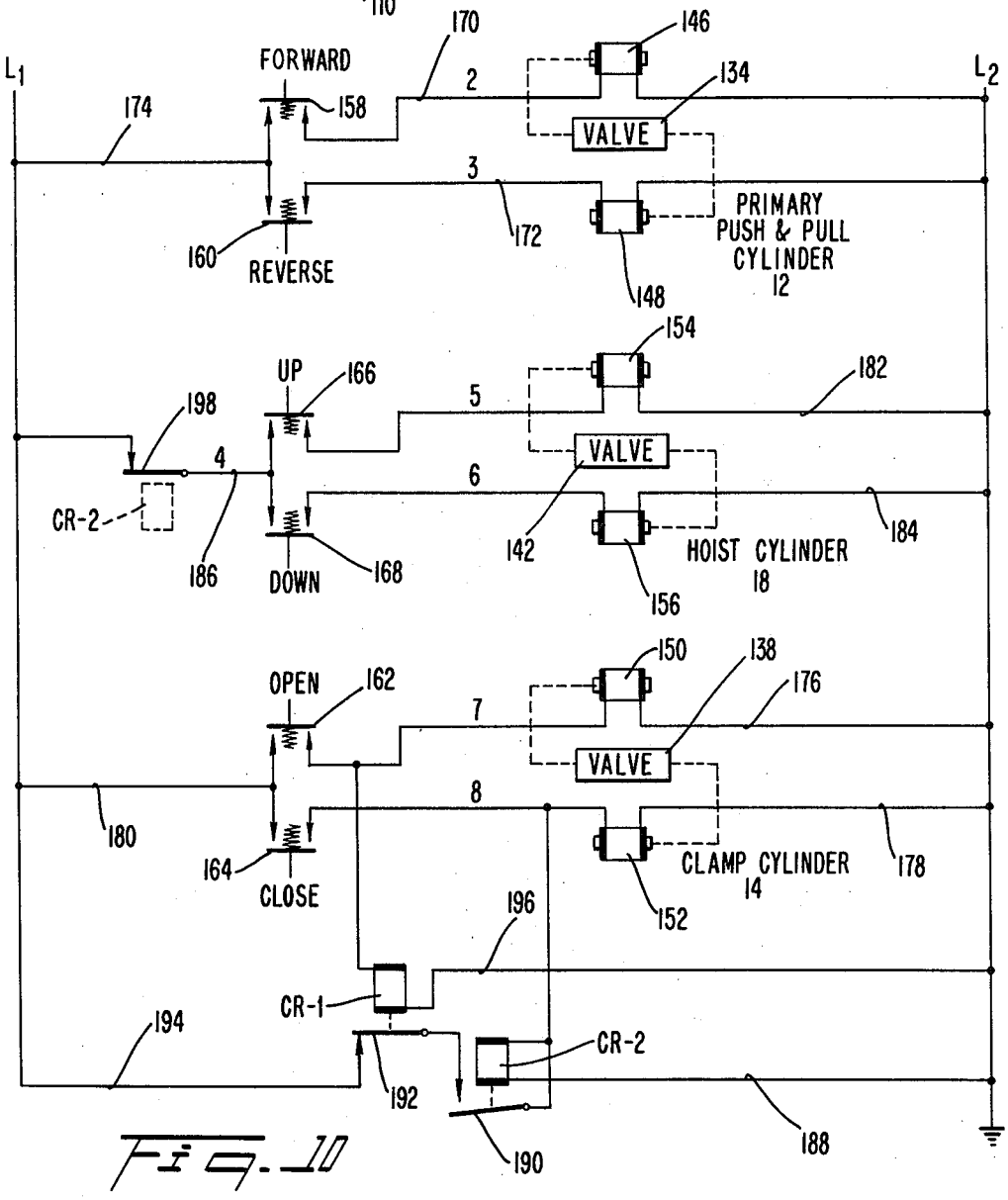
Fig. 10

VEHICLE MOVING APPARATUS

FIELD OF THE INVENTION

The present invention relates generally to apparatus for moving cargo vehicles, such as railroad cars, and more particularly to apparatus which is mounted on overhead framework structure so as to be disposed above the railroad cars and which is able to move a railroad car, or a train of coupled railroad cars, either in a forward or backward mode, or retain the car or train at a predetermined position.

BACKGROUND OF THE INVENTION

In the performance of loading and unloading operations with respect to railroad hopper cars, the periodic movement of a car, or the sequential positioning of individual cars of a train of coupled cars, either in a forward or backward mode, is essential. For example, all loading and unloading stations are set up so that as one car or section of the car is completed, the next car or section must be moved to receive or discharge its material.

There are several different types of apparatus and methods conventionally employed for accomplishing the foregoing operations, the most common of which utilizes one or more steel cables operatively connected to a rotatable drum. The cable is connected to the railroad car and the same is advanced by rotating the drum through means of a drum motor and transmission mechanism. These systems have generally proven quite complex as the cables must necessarily be routed about sheaves or within conduits or raceways disposed underneath the tracks. In addition, if the cables are disposed above ground, then the same become hazardous obstacles to both machinery and personnel. Still further, the fact that such cables are severaly tensioned during operation serves to present an additional potential hazard to personnel should the cable snap.

In addition to the complexity and safety problems characteristic of the aforementioned cable system, the same are also considerably expensive to install and maintain. Installation techniques utilized in conjunction with such systems necessarily entail the location of the cable drum and motor transmission mechanism at a distance from the track being serviced by such elements in order to provide sufficient clearance between the rail cars and the elements. Furthermore, when the cables are routed underneath the rail tracks within cable troughs or raceways, as aforenoted, the troughs present maintenance problems, and this is true regardless of whether or not the troughs or raceways are open or covered.

Another type of apparatus and method which is conventionally employed for performance of the foregoing operations comprises the disposition of the rail tracks upon a grade which is inclined downwardly toward the loading or unloading station. Wheel chocks are disposed in front of one or more wheels in order to prevent forward movement of the rail car or cars, and the same are removed in order to permit the car or cars to advance forwardly. This mode of operation is necessarily performed many times during a hopper car loading operation, and in addition, is quite hazardous due to the fact that the laden rail cars sometimes jump over or push aside the chocks and roll free.

Car type jacks have been conventionally employed for many years in order to move rail cars. In using such apparatus, jacks are interposed between a wheel of the car and the track. The rail car is moved forwardly by means of a person exerting a downward force upon the lever arm of the jack. In some cases, this method is used to overcome the static friction of the wheels of the car at rest on a grade bed; the operator jumping on the car to use the brake. In other cases, this method of operation serves to move the car several inches at a time. Consequently, such a mode of operation must be repeated numerous times in order to advance a car a considerable distance. As can be realized, either of these modes of operation is quite dangerous. This is particularly true if the operator slips or falls, and considering the operative characteristics of such apparatus, the likelihood of such occurring is seen to be considerable.

Hydraulically activated mechanisms for moving railroad cars have also been conventionally employed, and the same normally comprise hydraulic cyclinders which are disposed along the track rails and which energize dogs which move the cars in a forward mode. The operative disadvantages of such apparatus are: (1) the mechanism can only move the cars forwardly, (2) the dogs sometimes slip from engagement unexpectedly releasing the rail car, (3) the lifting force of the dogs tends to derail empty cars, and (4) there is no means for retarding the movement of the cars. In addition, the regions of the track bed within which the hydraulic cylinders are located must be constantly maintained and cleaned in order to prevent the mechanisms from fouling, and consequently, the installation or employment of such apparatus is somewhat limited. For example, such apparatus could not be readily employed within coke plants or other establishments where material spillages normally occur.

OBJECTS OF THE INVENTION

Accordingly, it is an object of the invention to provide a new and improved apparatus for moving railroad cars, and other vehicles, such as barges.

Another object of the invention is to provide a new and improved apparatus for moving railroad cars which overcomes the aforenoted problems of the prior art.

Still another object of the present invention is to provide a new and improved apparatus for moving railroad cars which is able to move a railroad car, or train of coupled railroad cars, either in a forward or backward mode, or retain the car or train at a predetermined position.

Yet another object of the invention is to provide a new and improved apparatus for moving railroad cars which is capable of moving a car, or a train of coupled cars, in a continuous manner so as to achieve a predetermined movement within a predetermined limited movement range.

Still another object is to provide a new and improved apparatus for moving railroad cars which is considerably simplistic in structure.

Another object of the present invention is to provide a new and improved apparatus for moving railroad cars which has a relatively safe mode of operation.

A further object of the invention is to provide a new and improved apparatus for moving railroad cars which is relatively inexpensive to install and maintain.

A still further object of the invention is to provide a new and improved apparatus for moving railroad cars which is readily adaptable to existing railroad facilities.

BRIEF DESCRIPTION OF THE INVENTION

The railroad car moving apparatus of the present invention comprises a cooperative assembly of three, doubleacting hydraulic cylinders supportingly mounted upon trackside framework structure which passes over the rail tracks and the cars thereon. In this manner, the hydraulic apparatus is suspended in an overhead fashion with respect to the railroad cars. A first, push-pull hydraulic cylinder mechanism is employed for extension and retraction purposes in a longitudinal direction which extends parallel with the tracks and cars. The push-pull mechanism is disposed toward one side of the tracks. The inventive apparatus may of course, be applied in other environments, such as on barge unloading docks, to move barges in the same fashion as the rail cars.

A second clamping hydraulic cylinder mechanism is secured to the free end of the first mechanism and includes laterally disposed clamping members which approach each other in a face-to-face lateral relationship. The railroad cars conventionally comprise side wall and upper side rail members, and this portion of the car is easily engaged between the clamping members. The clamping faces of the clamping members are serrated in order to facilitate the clamping operation, and as a result of the foregoing, the railroad cars are positively grasped whereby the cars may be moved either in a forward or backward mode, or alternatively, the hydraulic clamping mechanism may impart a retarding force upon the cars so as to retard movement of the same or to maintain such at predetermined positions. The third or hoist hydraulic cylinder mechanism operates in conjunction with the first two mechanisms, and more particularly, is provided for elevating or lowering the first mechanism so as to advantageously position the same whereby the second clamping mechanism may actually clamp the car side wall and side rail structure.

Once so clamped, the first mechanism may be retained in its position achieved during the clamping operation, or may be extended or retracted in order to move the railroad car or train of coupled cars either in the forward or backward mode. The foregoing apparatus may be utilized in conjunction with a boom type conveyor also pivotably supported on the trackside framework structure, and in this manner, the railroad car or train of cars may be positioned at predetermined positions relative to the boom conveyor so as to properly receive the materials discharged from such conveyor.

Within a second embodiment of the clamping mechanism of the present invention, guide means are incorporated within the structural assembly thereof in order to facilitate the positioning of the clamping members relative to the railroad car side wall and side rail.

In order to additionally correlate the operative cycles of the various hydraulic cylinder mechanisms, the electrical circuitry for the same, which employs solenoid control valves, also includes a lock-out and holding circuit whereby the hoist mechanism can only be activated at certain particular times relative to the operation of the clamping mechanism, and cannot be activated at any other time. This serves to prevent any inadvertent dislodging of the clamping mechanism from the railroad car.

Still other objects and advantages of the invention will become readily apparent to those skilled in this art from the following detailed description wherein I have shown and described only the preferred embodiments of the invention, simply by way of illustration of the best modes contemplated by me of carrying out my invention. As will be realized, the invention is capable of other and different embodiments, and its several details are capable of modification in various obvious respects, all without departing from the invention. Accordingly, the drawings and description are to be regarded as illustrative in nature, and not as restrictive.

BRIEF DESCRIPTION OF THE DRAWINGS

FIG. 6 is an enlarged front elevation, partly in section, of the clamping mechanism of the present invention;

FIG. 7 is a cross sectional view of the apparatus of FIG. 6 taken along the line 7—7 of FIG. 6;

FIG. 8 is a view similar to that of FIG. 6 showing however, a second embodiment of the clamping apparatus of the present invention;

FIG. 9 is a cross sectional view of the apparatus of FIG. 8 taken along the line 9—9 of FIG. 8.

DETAILED DESCRIPTION OF THE PREFERRED EMBODIMENTS

Figure 1:
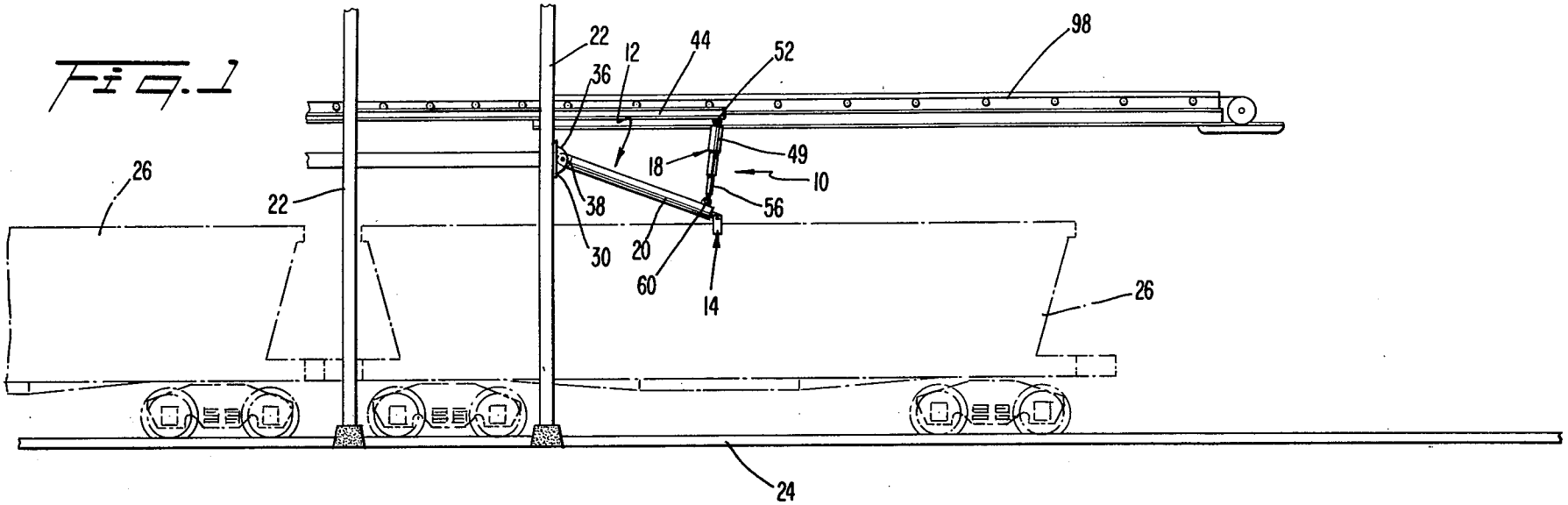
FIG. 1 is a side elevation view of apparatus for moving railroad cars which is constructed in accordance with the present invention.
Figure 2:
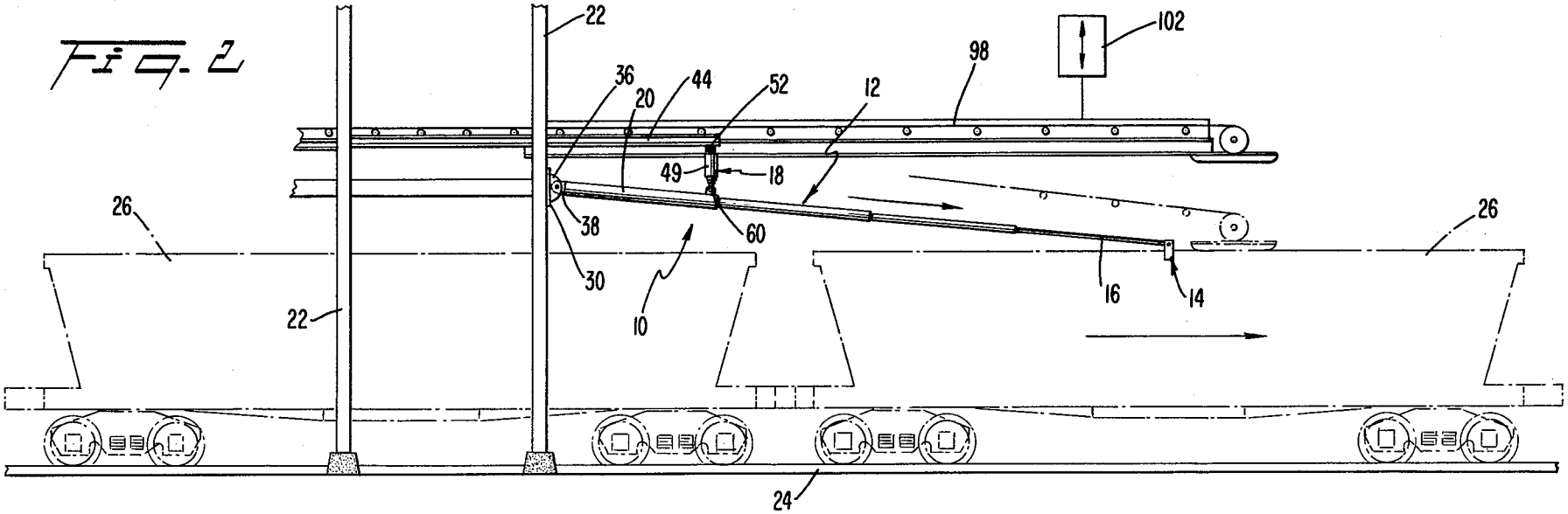
FIG. 2 is a view similar to that of FIG. 1 with the railroad cars advanced somewhat by means of the apparatus of the present invention.

Referring now to the drawings, and more particularly to FIGS. 1–7 thereof, the apparatus of the present invention is generally indicated by the reference character 10 and is seen to include a four-stage, double-acting, telescopic push and pull hydraulic cylinder mechanism 12, a double-acting clamping hydraulic cylinder mechanism 14 pivotably secured to the free or forward end of the first or innermost section 16 of cylinder mechanism 12, and a three-stage, double-acting, telescopic hoisting hydraulic cylinder mechanism 18 pivotably secured to the free or forward end of the fourth or outermost section 20 of cylinder mechanism 12.

Conventional stanchions 22 of the I-beam type are disposed to the side of railroad tracks 24 upon which railroad cars 26 ride, and another support member 28, also of the I-beam type is fixedly secured to one of the stanchions 22 and extends transversely across tracks 24 at a height which is above that of the upper surface of the railroad cars 26. A bracket 30, having rearwardly projecting upper and lower sets of ribs 32, is adapted to be mounted upon the forwardly facing surface of I-beam 28 with ribs 32 encompassing the beam so as to support the bracket 30 thereon. Bracket 30 is fixedly secured to I-beam 28 by means of a plurality of rivets 34 and a pair of forwardly projecting, laterally spaced ears 36 are fixedly secured to bracket 30 so as to, in effect, define with the base thereof a clevis member. The rear end of the fourth section 20 of cylinder mechanism 12 is similarly provided with a pair of rearward projecting, laterally spaced ears 38 which likewise form therewith a clevis member, ears 38 being disposed inwardly of ears 36. An additional bearing member 40 is also affixed to bracket 30 so as to project forwardly therefrom and the same is centrally interposed between ears 38. Ears 36 and 38, as well as member 40, are provided with transversely extending through bores, and a pivot pin 42 is passed therethrough. In this manner, the rear end of cylinder mechanism 12 is pivotably secured to bracket 30.

As is apparent from the Figures, the longitudinal extent of cylinder mechanism 12 is directed parallel to railroad tracks 24, and is disposed on one side of the tracks for a purpose to be described hereafter. Another I-beam 44 is similarly disposed and is secured to stanchions 22 by means of transversely extending supporting I-beams 46. The forward end of I-beam 44 is provided with a pair of ears 48 which depend from the lower surface thereof, and the upper end of the outermost section 49 of hoist cylinder 18 is provided with a single, upstanding ear 50 which is adapted to be interposed between ears 48. Ears 48 and 50 are provided with transversely extending through bores and a pivot pin 52 is disposed therethrough so as to pivotably support hoist mechanism 18 on I-beam 44.

The forward end of the fourth section 20 of cylinder mechanism 12 is similarly provided with an upstanding ear 54 while the lower end of the innermost section 56 of hoist cylinder 18 is provided with a pair of dependent ears 58. Ear 54 is adapted to be interposed between ears 58 and the same are provided with transversely extending through bores. A pivot pin 60 is inserted through such bores, and in this manner, relative pivotable movement is provided between cylinder mechanisms 12 and 18. It will be appreciated that extension or retraction of hoist cylinder mechanism 18 will serve to arcuately lower or elevate push-pull cylinder mechanism 12, as may be seen in FIGS. 1 and 2, the angular movement of mechanism 12 transversing an arcuate extent of, for example, 20°.

As best seen in FIGS. 4–7, the forward end of the innermost section 16 of push-pull cylinder mechanism 12 is provided with a pair of forwardly projecting, laterally spaced ears 62 so as to, in effect, form a clevis member therewith, and a vertically extending plate 64 is adapted to be interposed therein. Ears 62 and plate 64 have transversely extending through bores provided within the central and upper portions thereof, respectively, and a pin 68 is disposed therethrough. In this manner, plate 64 is pivotably supported on the free end of cylinder mechanism 12.

The lower portion of plate 64 has integrally formed therewith a laterally extending support member or base 70, and a substantailly square through bore 72 is provided within that portion of plate 64 which is disposed immediately above base 70. A double-acting hydraulic cylinder 74 of cylinder mechanism 18 is supported on base 70 with the piston end of cylinder 74 disposed within bore 72. It is noted that the vertical extent of bore 72 is less than the diameter of cylinder 74, however, the upper central surface of base 70 is provided with a channel or groove 75 which extends parallel to the longitudinal axis of cylinder 74. The lower peripheral portion of cylinder 74 is seated in groove or channel 75 and in this manner, good stability is imparted to the cylinder 74.

A piston rod 76 extends laterally away from plate 64 in a direction opposite that in which base 70 extends relative to plate 64, and the free end of piston rod 76 is integrally secured to a vertically dependent bracket 78. Base 70 is provided with laterally extending support bars 80 which are disposed parallel to and below piston rod 76. The central portion of bracket 78 is provided with through bores 82 through which bars 80 extend, and the lower portion of bracket 78 is provided with a laterally extending clamping member 84. Member 84 is disposed beneath bars 80 and parallel thereto, and the same is supported in a cantilevered manner from bracket 78. A clamping element 85, having a serrated face 86 for facilitating the clamping operation, is fixedly secured to the free end surface of member 84.

The lateral side of base 70 which is disposed away from vertical plate 64 is provided with a vertically dependent clamp member 88; and a clamping element 90, having a serrated face 92 for similarly facilitating the clamping operating, is likewise fixedly secured to the laterally inwardly facing surface of member 88. the serrated clamping faces 86 and 92 thus face each other in a laterally spaced arrangement with the spacing therebetween being adjustable by means of the extensible action of cylinder 74 and piston rod 76. The railroad cars 26 are conventionally provided with an upstanding side wall 94 and an upper side rail 96 secured to the uppermost portion thereof. As best seen in Fig. 6, as a result of the dispostion of cylinder 12 toward the side of the track, the clamping apparatus as defined by members 84 and 88, with faces 86 and 92, is thus able to clampingly engage the side wall 94 and side rail 96 of the car. This is a positive attachment so that push-pull mechanism 10 can move the car either forwardly or backwardly, or alternatively, retard the movement of the same. Once the new position is reached, the static hydraulic pressure in mechanism 10 maintains the car there until a new signal from the control circuit of the system is received.

It is to be noted that in utilizing the apparatus of the present invention, in order to, for example, load one of the cars 26 with a particulate material, the car 26 is initially disposed in the position shown in FIG. 1. The material to be loaded into the car is to be conveyed along a boom conveyor 98 which is pivotably supported on a transversely extending I-beam 100 which is disposed parallel to and above I-beam 28. A suitable, double-acting hydraulic cylinder mechanism 102 operatively moves the conveyor between its raised and lowered positions, as may well be appreciated.

When the car 26 has reached the position shown in FIG. 1, cylinder mechanism 18 is initially extended so as to disposed cylinder mechanism 12 downwardly. Clamping mechanism 14 is then actuated whereby clamping elements 85 and 90 engage the side wall 94 and side rail 96 of railroad car 26, and upon completion of such operation, cylinder mechanism 12 is extended a predetermined amount so as to move the car 26 forwardly to the proper position. The boom conveyor 98 is now actuated downwardly by mechanism 102 and activated so as to discharge the material from the conveyor 98 into car 26.

Turning now to FiGS. 8 and 9, a second embodiment of the clamping mechanism 14 is disclosed, the primary difference of which, as compared to the embodiment of FIG. 6, resides in the employment of a different support base and the operative arrangement of the cylinder actuated clamping member associated therewith. In lieu of support base 70, a support base 104 is integrally secured to the bottom of vertical plate 64 and base 104 is seen to extend laterally outwardly on both sides of the vertical plane of plate 64. A double-acting cylinder 106 is supported below base 104, on one lateral side thereof, within a housing formed by means of a vertical plate member 108 and an upper set of mounting blocks 110 fixedly secured to base 104 by means of bolts 112. A lower set of mounting blocks 114 is also provided and a lower support base 116 is fixedly secured thereto by means of bolts 118. An essentially triangular guide member 120, as seen in FIG. 8, is integrally formed with base 116 such that an inclined side surface of the member 120 is directed toward the central portion of the mechanism 14.

Cylinder 106 includes a piston member 122 which is provided with a clamping element 124, the exposed face 126 of which is serrated similarly to face 86 of member 85. Another guide member 128, similar to member 120, is provided, in a dependent manner, on the opposite lateral side of base 104, and it is seen that member 128 likewise has an inclined side surface which is directed toward the central portion of mechanism 14. A clamping element 130 is secured on the upper, centrally disposed side of member 128 and the centrally disposed face 132 of element 130 is similarly serrated. It will be appreciated that in positioning the clamping mechanism 14 of FIG. 8 relative to railroad side wall 94 and side rail 96, the inclination of guide members 120 and 128 is such as to guide the clamping elements into their proper, relative positions whereupon attaining the same, cylinder 106 may be actuated so as to dispose piston 122 toward side wall 94 and side rail 96 for performance of the clamping function, all in a manner similar to the operation of the clamping mechanism of FIG. 6.

Figure 10A:
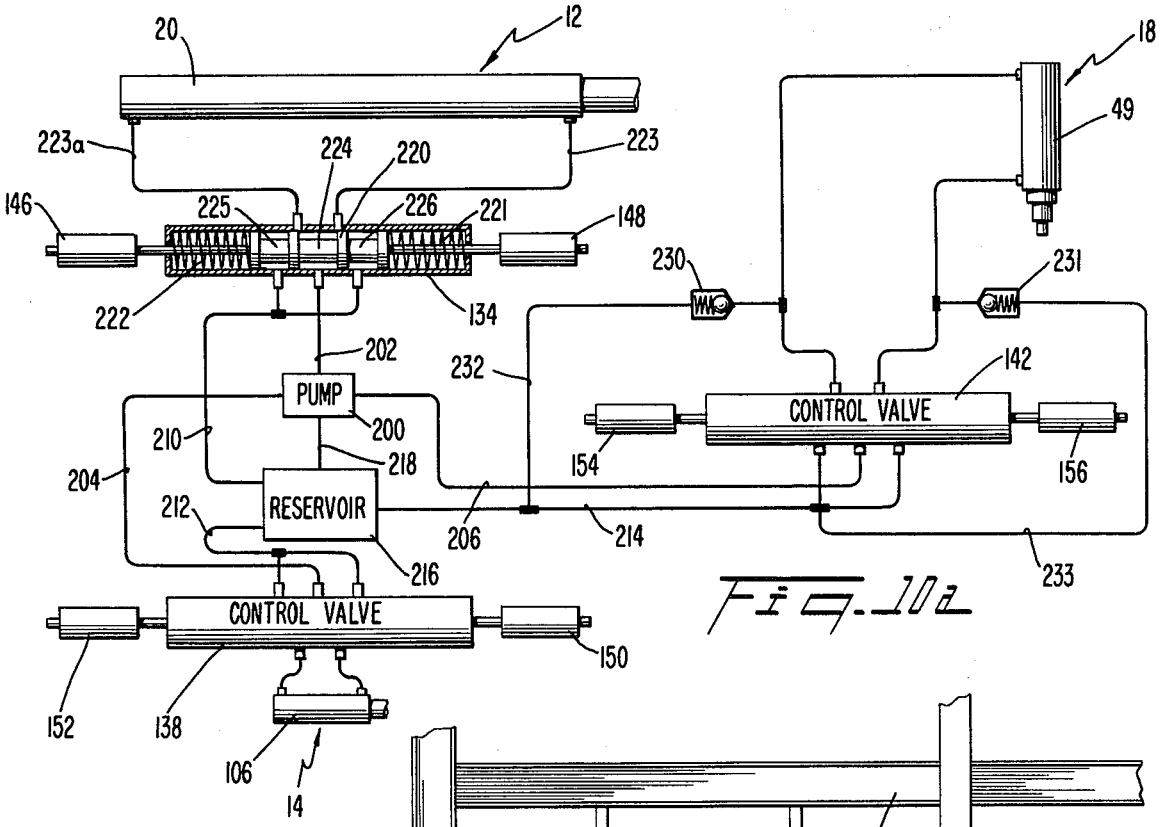
FIGS. 10 and **10*a*** are schematic electrical-hydraulic circuits embodying the apparatus of the present invention.
Figure 3:
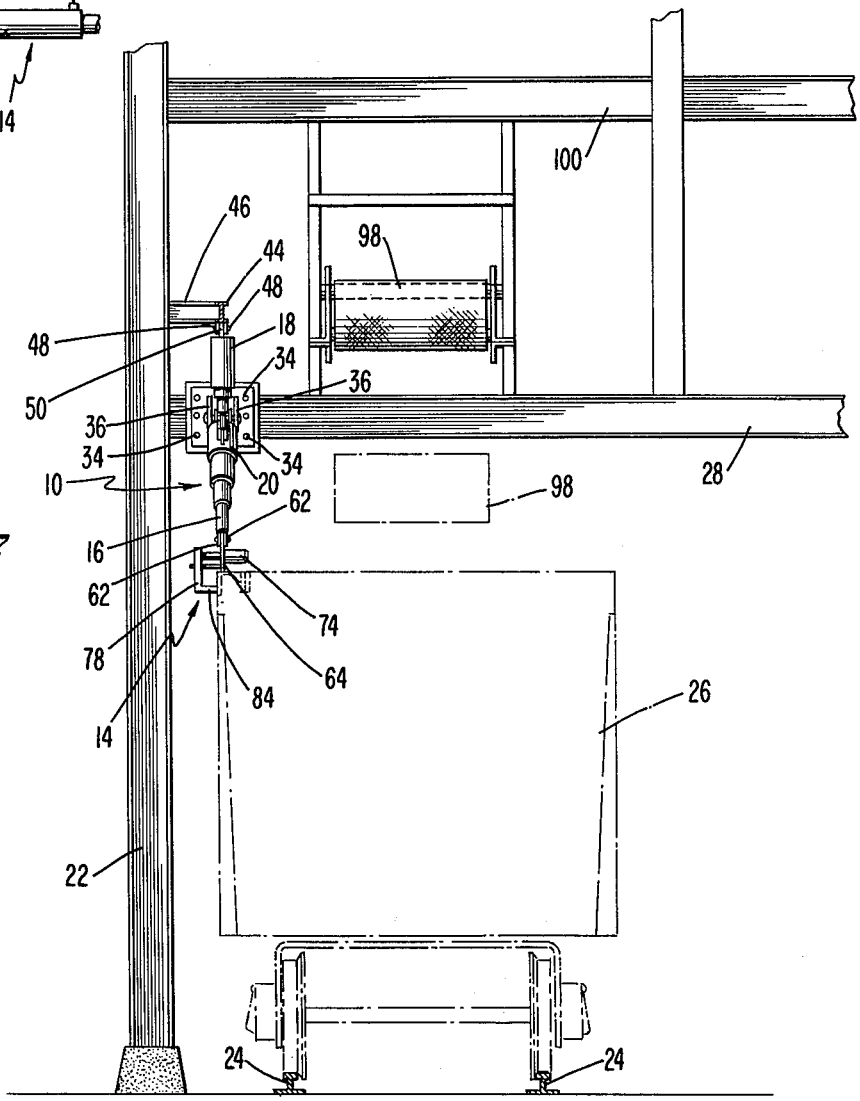
FIG. 3 is a front elevation view of the apparatus of FIG. 1.
Figure 4:
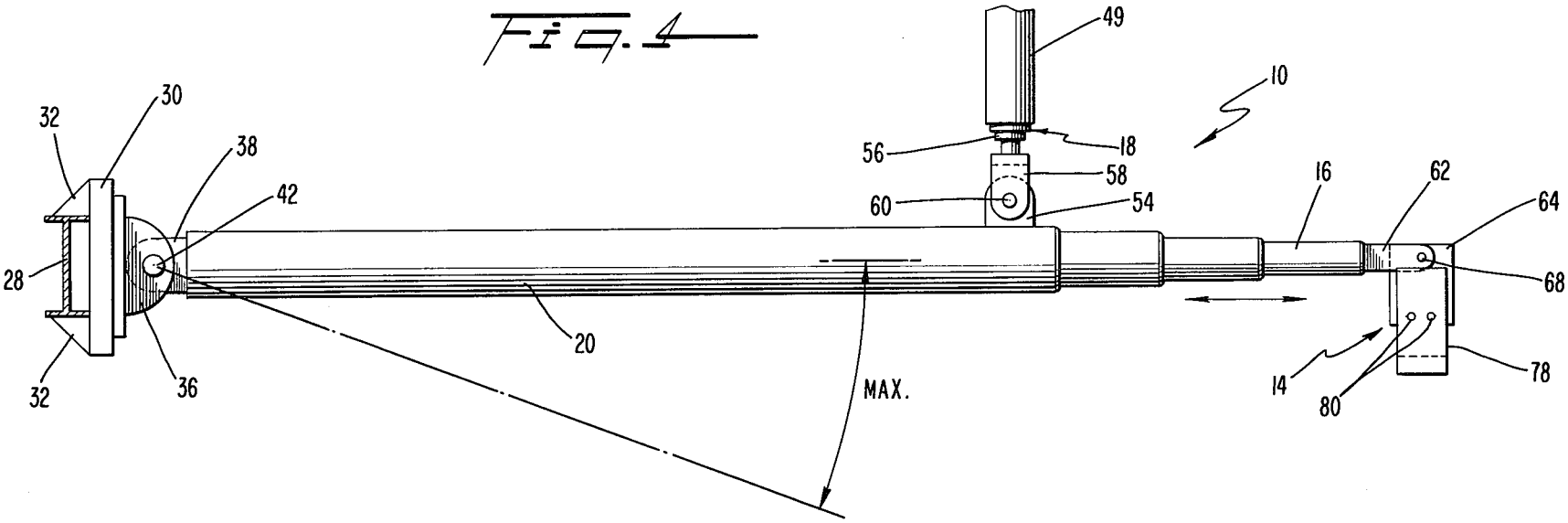
FIG. 4 is an enlarged side elevation view of the push-pull hydraulic mechanism of FIG. 1.
Figure 5:
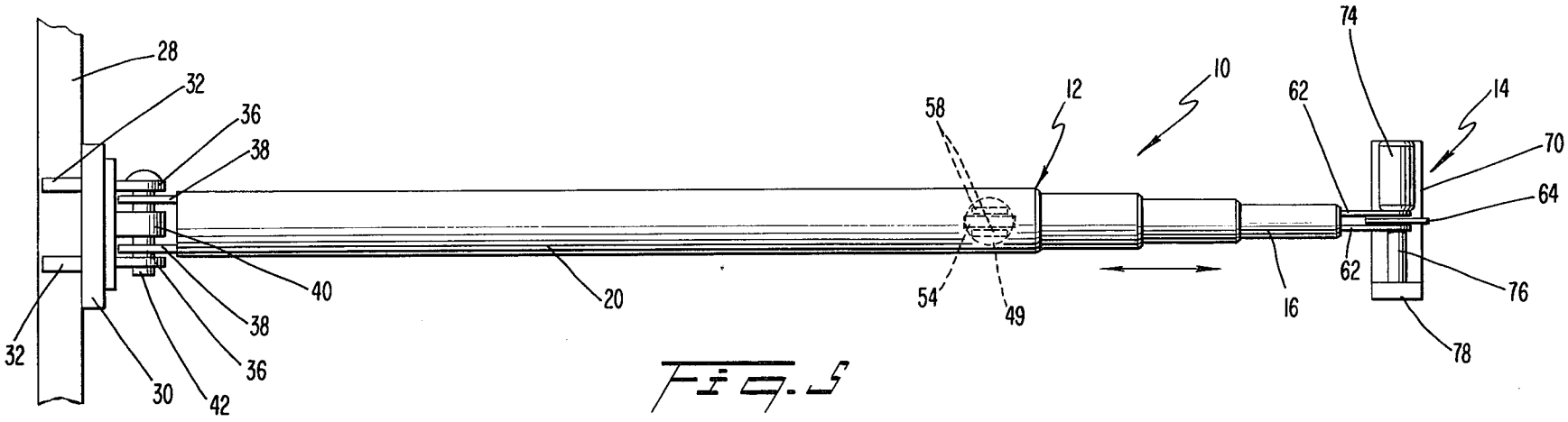
FIG. 5 is a plan view of the apparatus of FIG. 4.

Referring now to FIGS. 10 and 10*a*, schematic circuit diagrams for electrically and hydraulically controlling the cylinder mechanisms 12, 14 and 18 are shown. Electrical power lines are indicated at L1 and L2, and it is additionally seen that each of the double-acting cylinder mechanisms 12, 14 and 18 has hydraulic control valves indicated at 134, 138 and 142, respectively, operatively associated therewith. These valves are adapted to be controlled by means of solenoids 146, 148, 150, 152, 154 and 156, respectively, and the latter are in turn controlled by manually actuated spring-biased push-button switches 158, 160, 162, 164, 166 and 168, respectively, which are normally maintained in their open states by means of their associated springs. Electrical lines 170 and 172 interconnect power line L2 and solenoids 146 and 148 with switches 158 and 160, while a common line 174 interconnects switches 158 and 160 with power line L1. Similarly, electrical lines 176 and 178 electrically connect power line L2 and solenoids 150 and 152 with switches 162 and 164, while a common line 180 connects switches 162 and 164 with power line L1. Lastly, electrical lines 182 and 184 interconnect power line L2 and solenoids 154 and 156 with switches 166 and 168, while a common line 186 connects switches 166 and 168 with power line L1.

As may be appreciated from the foregoing description which discussed the operation of the cylinder mechanisms 12, 14 and 18, when performing a car movement operation, when the clamping mechanism 14 is actuated to its closed, clamped state, it is undesirable to permit the hydraulic actuation of the hoist mechanism 18 which would then tend to dislodge the clamp mechanism from the railroad car side wall and side rail. Consequently, in order to prevent the same from occurring, a lock-out and holding circuit is also incorporated within the system of FIG. 10 and is seen to comprise an additional electrical line 188 interposed between power line L2 and line 178 and within which there is disposed a relay coil CR-2. A normally open switch 190 is operatively associated with coil CR-1. All of the latter switches are connected by electrical line 194 and with power line 11. Still another line 196 serves to connect line 176 with coil CR-1 and the latter with line L2. Coil CR-2 is also operatively associated with another normally closed switch 198 disposed within line 186 so as to maintain the same closed.

From the foregoing, it will be seen that when switch 164 is closed, electrical power is supplied to solenoid 152 which actuates valve 142 whereby hydraulic fluid is conducted into the clamp mechanism 14 so as to perform a clamping function. Simultaneously, power is supplied through line 88 and relay CR-2 so as to close normally open switch 190 and hold the solenoid even when the switch 164 is released. Coil CR-2 also opens normally closed switch 198 and consequently, the hoist mechanism 18 cannot be actuated in either direction.

When switch 162 is closed so as to open the clamp mechanism 14, power is supplied to solenoid 150 which actuates valve 142 in the opposite direction, and in addition, power is also supplied to coil CR-1. Energization of the latter opens normally closed switch 192 which thereby terminates power flowing through line 194. As a result, coil CR-2 is de-energized which then releases switch 198 so as to permit the same to again assume its normally closed state.

The hydraulic circuit of FIG. 10a includes a pump 200 supplying pressurized fluid through feed lines 202, 204 and 206 to the hydraulic mechanisms 12, 14 and 18 through valves 134, 138 and 142. Return lines 210, 212 and 214 send the low pressure fluid back to reservoir 216 and thence back to pump 200 through line 218.

Each of the control valves 124, 138 and 142 is of the convention flow-splitting type used in power steering and other types of industrial applications and comprises a spool 220 (see valve 134) centered by springs 221, 222 in the valve housing. In operation, in the centered position of the valve, high pressure fluid is fed to both ends of the piston 220 (and each additional extensible section) by connectors 223, 223*a* through the central groove 224 of the spool. The cylinder 20 is thus held securely keeping the rail car 26 in position when the positioner of this invention is in use.

When movement is desired, the appropriate solenoid 146, 148 is activated to move the spool 220, exhausting one side of the piston through the appropriate end grooves 225, 226, while at the same time, the opposite side of the piston is provided with full pressure through the central groove 224. The car 26 is thus moved in a smooth, controlled fashion. By pulsing the operation of switches 158, 160, the car may be retarded or slowed as desired in either direction.

The operation of valves 138, 142 is udnerstood to be the same as just described. However, pressure relief bypass valves 230, 231 and corresponding bypass lines 232, 233 for valve 138 serve to return fluid to return line 214 at a predetermined threshold value as the hoist hydraulic mechanism 18 is extended or retracted by action of the push-pull mechanism 12 (cf. FIGS. 1 and 2). These bypasses also serve to insure that the car 26 will not be moved vertically unintentionally, since the threshold value is set just above that necessary to raise and lower the push-pull mechanism 12.

In summary, an improved apparatus for moving railroad cars or other vehicles for loading or unloading is disclosed. As a result of the simple electrical-hydraulic control system of the present invention, and the disposition of the same above the railroad cars, the apparatus of the present invention is substantially safer in its operation than conventional systems. In addition, the positioner of the invention allows for positively moving a railroad car or a train of coupled cars either in a forward or backward mode in infinite increments. The moving operation in either direction may be carried out rapidly, but at all times the operator is in full control by remote control at a safe distance. Retarding the movement of the car or train of cars is efficiently provided, as is the ability to maintain the cars at any predetermined position under a secure hydraulic holding force.

In this disclosure there is shown and described only the preferred embodiment of the invention but, as aforementioned, it is to be understood that the invention is capable of use in various other combinations and environments, and is capable of changes or modifications within the scope of the inventive concept as expressed herein.

I claim:

1. Vehicle moving apparatus for moving one or more railroad cars having side walls along a predetermined path, comprising:

support means fixedly dispoed at an elevation which is higher than the upper surface of the car;

first hydraulic cylinder means mounted at one end thereof upon said support means and extensible and retractable in a plane parallel to said railroad tracks for controlling the movement of said cars along said tracks;

second hydraulic cylinder clamping means secured to the other end of said first cylinder means and being extensible and retractable in a plane disposed transverse to said tracks for engaging said railroad car; and third hydraulic cylinder means secured at one end thereof to said support means and to said first cylinder means at the other end thereof and extensible and retractable within a vertical plane for controlling the elevation of said first and second hydraulic means relative to said railroad car.

2. Apparatus as claimed in claim 1, wherein said car has a side rail and the clamping means comprises clamping members which are transversely spaced and disposed in a face-to-face relationship so as to clampingly engage said side wall and said side rail therebetween.

3. Apparatus as claimed in claim 1, wherein the said first and third hydraulic means are multi-stage telescopic hydraulic cylinders.

4. Apparatus as claimed in claim 1, further comprising guide means supported upon said clamping means for guiding said clamping means into operative engagement with said side wall and said side rail.

5. Apparatus as claimed in claim 4, wherein said guide means comprises inclined surface which are directed toward clamping members of said clamping means so as to operatively maneuver said clamping members into the proper positional orientation with respect to said side wall and said side rail.

6. Apparatus as claimed in claim 1, wherein said hydraulic cylinder mechanisms have solenoid controlled valves operatively associated therewith.

7. Apparatus as claimed in claim 6, wherein said solenoid controlled hydraulic valves are disposed within an electrical control circuit; and said circuit includes means for permitting or preventing the actuation of at least one of said solenoid controlled valves in response to actuation of another one of said solenoid controlled valves.

* * * * *